US005441087A

United States Patent [19]

Alberyd et al.

[11] Patent Number: 5,441,087

[45] Date of Patent: Aug. 15, 1995

[54] YARN STORAGE AND FEED DEVICE UTILIZING CORRECTIONAL AIR JET NOZZLES

[75] Inventors: Ake Alberyd, Ulricehamn; Jerker Hellström, Nol, both of Sweden

[73] Assignee: Iro AB, Ulricehamn, Sweden

[21] Appl. No.: 167,937

[22] PCT Filed: Jun. 16, 1992

[86] PCT No.: PCT/EP92/01362

§ 371 Date: Apr. 19, 1994

§ 102(e) Date: Apr. 19, 1994

[87] PCT Pub. No.: WO92/22693

PCT Pub. Date: Dec. 23, 1992

[30] Foreign Application Priority Data

Jun. 18, 1991 [SE] Sweden ..... 9101941

Jun. 20, 1991 [DE] Germany ..... 41 20 413.1

[51] Int. Cl.[6] ..... D03D 47/34

[52] U.S. Cl. ..... 139/452; 139/450

[58] Field of Search ..... 139/452, 450

[56] References Cited

U.S. PATENT DOCUMENTS 5,072,760 12/1991 Kaufman ..... 139/452

5,094,275 3/1992 Shaw et al. ..... 139/452

5,109,891 5/1992 Maina ..... 139/452 X 5,181,544 1/1993 Deiuri ..... 139/452

FOREIGN PATENT DOCUMENTS

0269140A1 6/1988 European Pat. Off. .

0418948A1 3/1991 European Pat. Off. .

0420176A1 4/1991 European Pat. Off. .

3734284A1 4/1989 Germany .

*Primary Examiner*—Andrew M. Falik

*Attorney, Agent, or Firm*—Flynn, Thiel, Boutell & Tanis

[57] ABSTRACT

A yarn storage and feed device with a main body, a take-up element on which the yarn is wound, a storage surface for yarn storage, a threading device with a compressed-air feeder system and a device for activating direction-jet nozzles. At least one direction-jet nozzle is located between the point of entry of the yarn into the storage and feed device and the feed-out point from the yarn-winding element; this nozzle can be activated independently of the nozzles fitted downstream of the feed-out point so that in the event of a partial failure, where stored yarn remains on the storage surface, the yarn end can be blown below the feed-out point.

18 Claims, 3 Drawing Sheets

YARN STORAGE AND FEED DEVICE UTILIZING CORRECTIONAL AIR JET NOZZLES

FIELD OF THE INVENTION

The present invention relates to a yarn storage and feed device provided with directional air jet nozzles which are selectively activated to correct partial and total failure conditions caused by yarn breakage.

BACKGROUND OF THE INVENTION

In a yarn storage and feed device described in DE-A1-37 34 284, the threading device comprises direction-jet nozzles and air guidance surfaces. In case of yarn breakage, the free yarn end of the broken yarn or of a spare yarn is moved by activating all direction-jet nozzles from the inlet into the yarn storage and feed device through the winding element and then along a detour path as compared with the normal yarn path along the storage drum into the guide opening, for instance, when the drive is stopped in a predetermined position. In case of partial failure with yarn breakage between the inlet and the storage drum, one ignores the fact that a regular yarn supply from which the yarn runs correctly into the guide opening might still be present on the storage drum. Unnecessary and time-consuming extra work is performed during the threading operation, for continuous threading is only required in case of total failure with yarn breakage where the yarn stored on the storage drum has also been consumed.

In a yarn storage and feed device described in EP 0 420 176, a first direction-jet nozzle assembly that has simultaneously supplied thereto two identical threads is provided in the inlet. At least one additional direction-jet nozzle is provided between the outlet of the winding element and the guide opening. Irrespective as to whether after yarn breakage there is a partial failure in which yarn is still stored on the storage surface or whether there is total failure in the case of which the yarn stored on the storage surface has been consumed after yarn breakage, both free yarn ends of the broken one yarn are eliminated in case of failure and the other yarn is newly threaded subsequently. To eliminate yarn possibly still stored on the storage surface, the winding element is turned back and the yarn is sucked back and discharged from the first direction-jet nozzle assembly.

In a yarn storage and feed device described in EP 0 269 140, partial failure caused by yarn breakage between the reel and storage drum with at least partly correct yarn supply on the storage drum is solely remedied in an automatic way. An auxiliary nozzle moves the yarn end of the broken yarn or of a spare yarn into the inlet of the yarn storage and feed device and up to the outlet of the winding element. A cutting device separates an initial part of the yarn supply on the storage drum to create a free yarn end at this place. Suction air nozzles suck in both yarn ends before a splicer connects the yarn ends. This principle presupposes an operation control device that quickly responds to yarn breakage. The threading device is not capable of eliminating total failure with an empty storage drum.

SUMMARY OF THE INVENTION

It is the object of the present invention to provide a yarn storage and feed device of the above-mentioned kind wherein unnecessary extra work can be avoided when the failure is eliminated and partial failure with yarn breakage can be remedied more rapidly than total failure. Under another aspect there is to be provided a yarn storage and feed device which is intelligent as to failure elimination and which is capable of classifying the respective type of failure and of eliminating the failure in a specific way within as little time as possible and, optionally, in an automatic way.

The above object is attained according to a first embodiment of the invention which utilizes a compressed-air conveying system including direction-jet nozzles. At least one direction-jet nozzle is arranged in a first section between a point of inlet into the device and an outlet, while at least one direction-jet nozzle is arranged in a second section between the outlet and a guide opening for the yarn. By means of an activating device, which determines whether a total or partial failure occurs in the system, either the direction-jet nozzles in the first section, or the direction-jet nozzles in the first and second sections, are activated.

If there is only a partial failure wherein the yarn is still stored on the storage drum, the new yarn end will only be blown out from the outlet of the winding element to some extent so that it can be knotted with the free end remaining on the storage drum, optionally by an automatic knotting device. The other available direction-jet nozzles are not activated, so that the yarn stored on the storage drum will not be destroyed, entangled or eliminated and there will also not be an impairment of the yarn along the further yarn path downstream of the storage drum. Partial failure can be remedied within a short period of time without any time being wasted on the elimination of the existing yarn supply. By contrast, in case of total failure in which the yarn supply on the storage drum has been consumed, the new yarn end is moved from the inlet of the yarn storage and feed device up to the guide opening. In case of partial failure any troublesome elimination of the yarn material still stored does not take place.

In a second alternative embodiment, the activating device consists of two activating-device parts can be gathered from claim 3. To eliminate total failure both parts of the activating device are used. By contrast, only one activating-device part is used for eliminating partial failure where the yarn is still correctly stored on the storage drum.

According to a further feature of the invention, in case of partial failure, e.g. yarn breakage in the hollow shaft of the winding element or in the transition region from the winding element to the drum surface or upstream of the yarn storage and feed device, there is a yarn supply on the storage surface. The yarn leading to the consumer still assumes a stable position. The condition that the activating-device part for eliminating partial failure should only be activated in such rotary positions of the winding element in which the threading position is absent ensures that the still intact yarn supply is not noticeably affected by the follow-up yarn and the air flow, but can still be used after knotting of the two free ends. Improved access to the blown-in yarn end might then be possible as well. It may be important that in case of partial failure the winding element is stopped in a rotary position in which the blown-in yarn end is positioned at or after a knotting or splicing device and that it is connected to the yarn on the storage drum rapidly and in an unobstructed way. This saves idle times for the consumer.

According to a still further feature, in a constructionally simple embodiment, in case of failure where the operation of the yarn storage and feed device is stopped an operator decides whether there is total failure or partial failure. The operator moves the change-over switch into the respective position for activating the threading device and for eliminating the failure.

According to still a further feature, the operation control device decides either on the basis of signals available to said device or, e.g., through remote control or through an operator's manipulation, which direction-jet nozzles are activated to eliminate partial failure or total failure.

According to another feature, in an embodiment of an automatic type, the desire for substantial automation of the operation of yarn storage and feed devices is taken into account. During operation of the device and even after stoppage thereof, the classifying device exploits still existing signals for classifying the failure and for discriminating whether the yarn end must be moved only up to the storage drum or right away to the guide opening. The failure is eliminated in response to the specific type of failure with a minimum of time and in an automatic way.

Another feature is of special advantage because the failure classifying device uses signals which exist at any rate or are produced specifically during failure and which indicate, for instance, whether the storage drum is empty or still filled.

This applies also to the alternative feature where the winding element need only be moved into the total-failure threading position in case of total failure. In case of partial failure the winding element remains in a different position which is of advantage to this type of failure. An intelligent system which is capable of making a distinction between the different types of failure and eliminates every failure in a time-saving and very simple manner is thereby created to copy with both cases.

Finally, the invention is simple from a constructional point of view, the capacity of the microprocessor of the operation control device or of the operation control device itself is used for this additional purpose. The elimination of a failure irrespective of whether this is a partial failure or a total failure only requires a short down-time of the yarn storage and feed device and the downstream consumer. In case of partial failure the yarn material need not be disposed of on the storage drum.

BRIEF DESCRIPTION OF THE DRAWINGS

Embodiments of the subject matter of the invention shall now be explained with reference to the drawing, in which.

DETAILED DESCRIPTION

Figure 1:
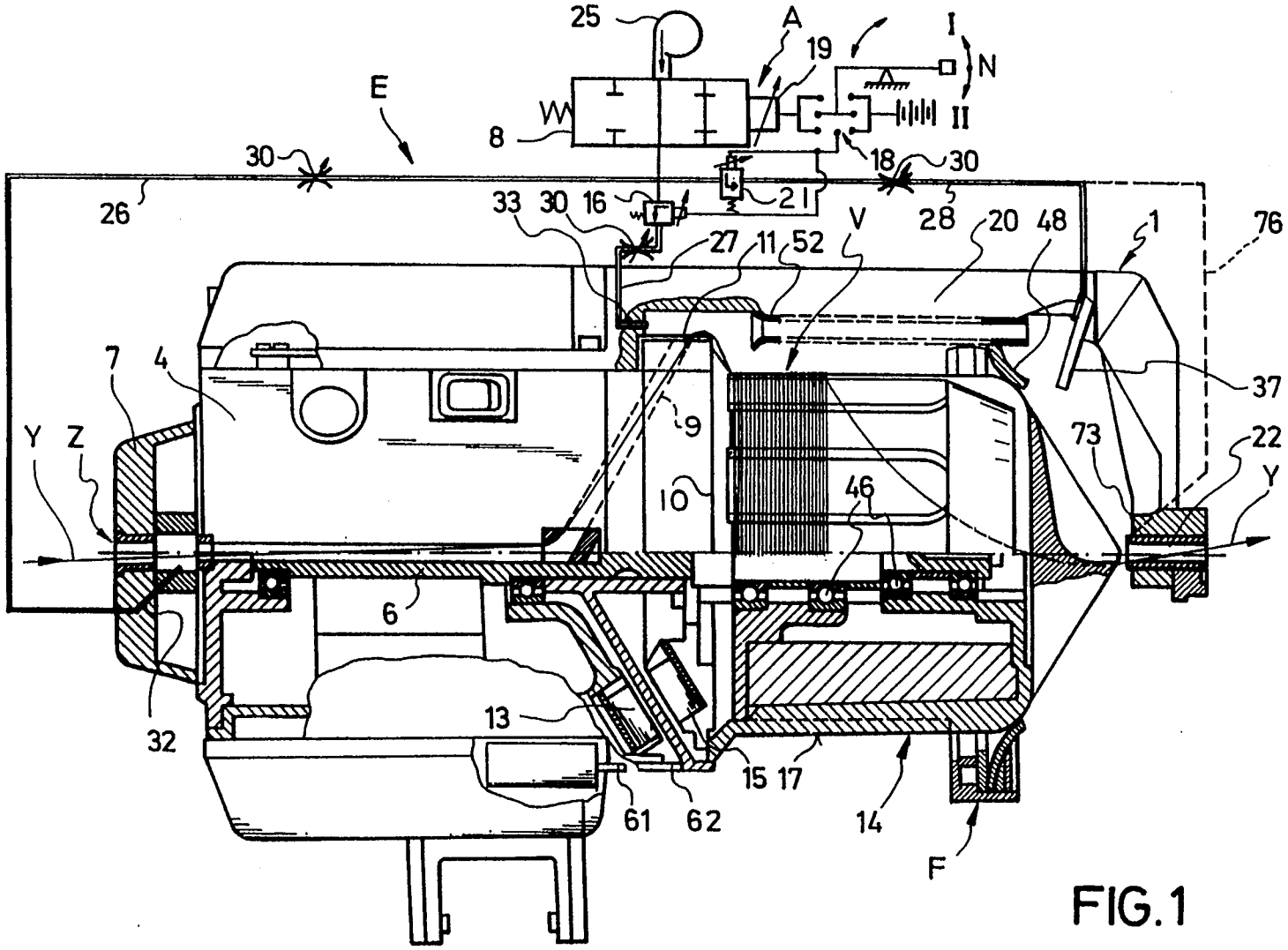
FIG. 1 is a longitudinal section through a first embodiment of a yarn storage and feed device.

A yarn storage and feed device 1 as shown in FIG. 1, which serves, e.g., to supply a weft yarn to a gripper or projectile weaving machine (not shown), and includes a main body 4 which supports a drive motor for a hollow shaft 6. A cover 7 is fixed at the feed end (feed-in point or inlet Z) of the main body 4. A concentric ring 10 is arranged on the hollow shaft 6. A channel-shaped take-up element or winding element 9 leads from the interior of the hollow shaft 6 to a feed-out point or outlet 11. Permanent magnets 13 are aligned in the main body with permanent magnets 15 which are provided in a storage drum 14 that is coaxial with hollow shaft 6. Storage drum 14 is rotatably supported on the hollow shaft 6 (bearings 46) and is blocked against co-rotation by permanent magnets 13, 15. The storage drum 14 defines a storage surface 17 for yarn storage V which consists of adjacent, possibly separated windings of a yarn Y, the windings being applied by the winding element 9. An arm 20 of the main body 4 extends alongside and in spaced relationship with storage drum 14. It holds a centric guide opening 22 and serves to accommodate yarn sensors (not shown) which serve to monitor and control the operation and to produce signals for a control device (not shown). Guide opening 22 may be a closed or slotted yarn eyelet or also the inlet of a main nozzle (not shown) of the weaving machine. The guide opening 22 may also be arranged on a holding device separated from the main body 4.

A compressed-air feeder system serves as a threading device E. A pressure source 25, e.g. a fan or a compressed-air storage means is provided for supplying compressed air. Pressure source 25 is connectable to a plurality of stationary direction-jet nozzles 32, 33, 37, 73 along the yarn path via an activating device A and supply lines 26, 27, 28 and optionally 76, in which volume or pressure control valves 30 are, for instance, arranged. The first direction-jet nozzle 32 that aims at hollow shaft 6 to move yarn Y through hollow shaft 6 and winding element 9 beyond outlet 11 is arranged in inlet Z. The next direction-jet nozzle 33 is arranged in the area of the circular path of outlet 11 and oriented approximately axially relative to a tube 52 which is stationarily arranged on arm 20 and slotted on the inside longitudinally or obliquely. A yarn brake F which is arranged on arm 20 and rests with brake elements 48 on the storage drum 14 extends through tube 52. Another direction-jet nozzle 37 which is oriented approximately radially to the inside can be arranged at the outlet of tube 52. Finally, another direction-jet nozzle 73 which is oriented in FIG. 1 to the right may be arranged in guide opening 22. At least nozzle 73 can be dispensed with in many cases.

On main body 4, a locking pin 61 can be slid into a recess 62 of ring 10, e.g. by means of a magnet, to position the outlet 11 in the area of direction-jet nozzle 37 when yarn Y has to be transported up to guide opening 22 (total-failure threading position). To this end, the drive motor (not shown) is rotated forwards or backwards by the operation control device at creep rate until the extended locking pin 61 locks. There may be a plurality of recesses 62 disposed in ring 10 to keep outlet 11 in at least one predetermined position in case of both total failure and partial failure. It is also possible to control these positionings electronically by means of the control device in the drive motor.

In the illustrated embodiment, the activating device A comprises a valve 8 which can be switched by means of a solenoid 19 against resilient force between a blocked position and a passage position, as well as a switching device 18 which is switchable from a zero position N (shut-off position of valve 8) into a total-failure position I and into a partial-failure position II. Furthermore, the activating device A includes inhibiting valves 16, 21 in supply lines 27, 28. In position I valves 8, 16, 21 are switched to passage. In position II, only valve 8 is switched to passage whereas valves 16, 21 are blocked. The activating device A is manually operable in FIG. 1. It is possible to operate the activating device A in a remote-controlled way. Furthermore, it could also be operated by the operation control device (not shown).

During normal operation, yarn Y passes from inlet Z through the winding element 9 into supply V and from said supply through yarn brake F and guide opening 22 to the consumer. The above-mentioned yarn sensors monitor, for instance, the size of supply V and transmit signals to the operation control device for activating or deactivating the drive in response to yarn consumption and the resultant change in the size of the supply or for controlling the speed of said drive.

In case of yarn breakage which is indicated by yarn sensors (not shown), the yarn storage and feed device 1 as well as the downstream consumer are deactivated and the failure is reported. An operator checks whether or not yarn supply V still exists on the storage surface 17. If supply V is still present, this is a case of partial failure. The activating device A is by the operator into position I for the elimination thereof. The yarn end of the broken yarn or a spare yarn is blown by means of the direction-jet nozzle 32 beyond outlet 11 and then linked with the yarn end of supply V, for which purpose an automatic splicer may optionally be provided. The activating device A is then switched into the neutral position N again and operation is resumed. Partial failure can be remedied in any rotary position of the winding element 9. However, the winding element 9 is expediently positioned, e.g., by the locking pin 61, in a predetermined partial-failure threading position.

If there is total failure with an empty storage surface 17, the operator will decide whether to switch the activating device A into position II, so that all intended direction-jet nozzles are activated in the total-failure threading position of the winding element 9 and the yarn end is blown from inlet Z into guide opening 22, i.e. with the help of tube 52 to bypass the obstacle presented by yarn brake F. The locking pin 61 is locked in this case. Upon elimination of the total failure the locking pin 61 is unlocked and operation is resumed.

Figure 2:
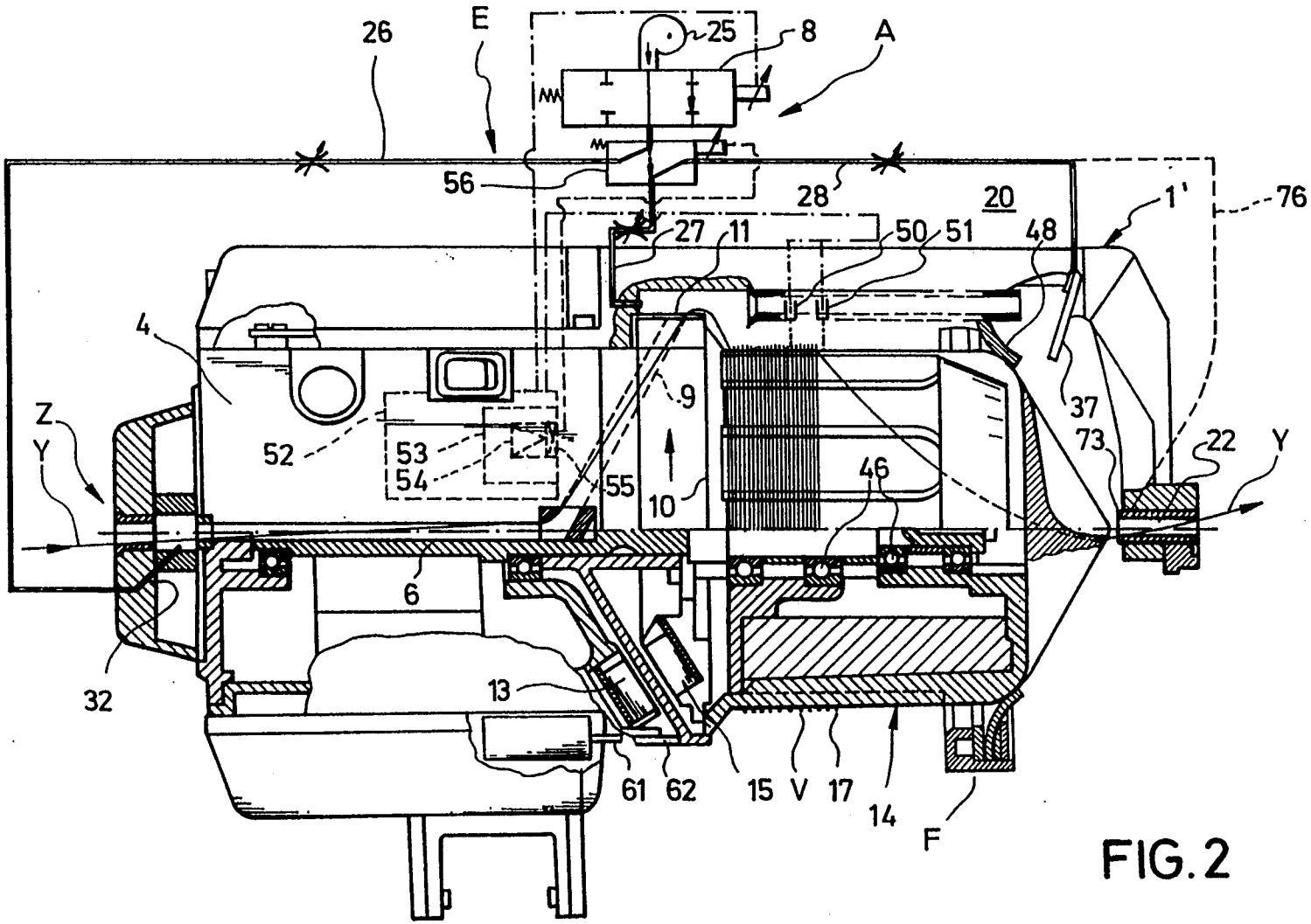
FIG. 2 is a longitudinal section through a modified embodiment.

In the embodiment of the yarn storage and feed device 1' according to FIG. 2, the threading device E operates automatically. The constructional configuration of device 1' largely corresponds to that of FIG. 1 so that corresponding parts have been designated by the same reference numbers.

Downstream of the solenoid valve 8, the activating device A comprises an on-off valve 56 which is switchable by means of a magnet and connects only the supply line 26 to the pressure source 25 in the one position whereas it connects the supply line 26 and the supply lines 27, 28 to the pressure source 25 in the other switching position. Two yarn sensors 50, 51 of any desired construction are arranged in arm 20 (only one yarn sensor could also be used for this purpose). The sensors sense the size of supply V on the storage surface 17 and send signals to the operation control device designated by 52, which is thermally insulated with respect to the drive motor, so as to indicate whether the supply has a specific maximum or minimum size. The operation control device 52 controls the drive motor (not shown) by means of these signals during normal operation. The operation control device 52 contains a microprocessor 53 which processes operation-specific parameters and yarn sensor signals. Moreover, a failure classifying device 54 is integrated into the operation control device 52, or the microprocessor 53, which includes a circuit 55 for activating the actuating magnet of the on-off valve 56.

In case of failure caused by yarn breakage the classifying device 54 determines whether this is a partial failure or a total failure, for instance on the basis of signals from the yarn sensors 50 and/or 51. This can, e.g., be accomplished in such a way that the signals from the yarn sensors 50, 51 which represent the presence of supply V are used for determining a partial failure whereas missing signals from the yarn sensors 50, 51 or signals from a separate yarn sensor used during operation or only in case of failure are used for determining total failure with an empty storage surface 17. The on-off valve 56 is operated or not in response to the failure sensed, so that all supply lines 26, 27, 28 are connected to the pressure source 25 for activating all direction-jet nozzles in case of total failure as soon as valve 8 is operated, whereas the on-off valve 56 is not operated and only supply line 26 is connected in case of partial failure. At least in case of total failure, the drive motor is still moved at creep speed to such an extent that locking pin 61 locks. As soon as the yarn end has passed from inlet Z to guide opening 22, operation is started again and locking pin 61 is retracted before. At the same time, the activating device A is deactivated by switching valve 8.

Alternatively, the respective threading position of the winding element 9 could also be used by the classifying device 54 as a criterion of decision because the total threading position is only employed in case of total failure whereas in case of partial failure the yarn end is blown in in every rotary position or in the partial-failure threading position of the winding element. To make the decision easier, another yarn sensor which is used during operation or an independent failure alarm could be used as well.

Figure 3:
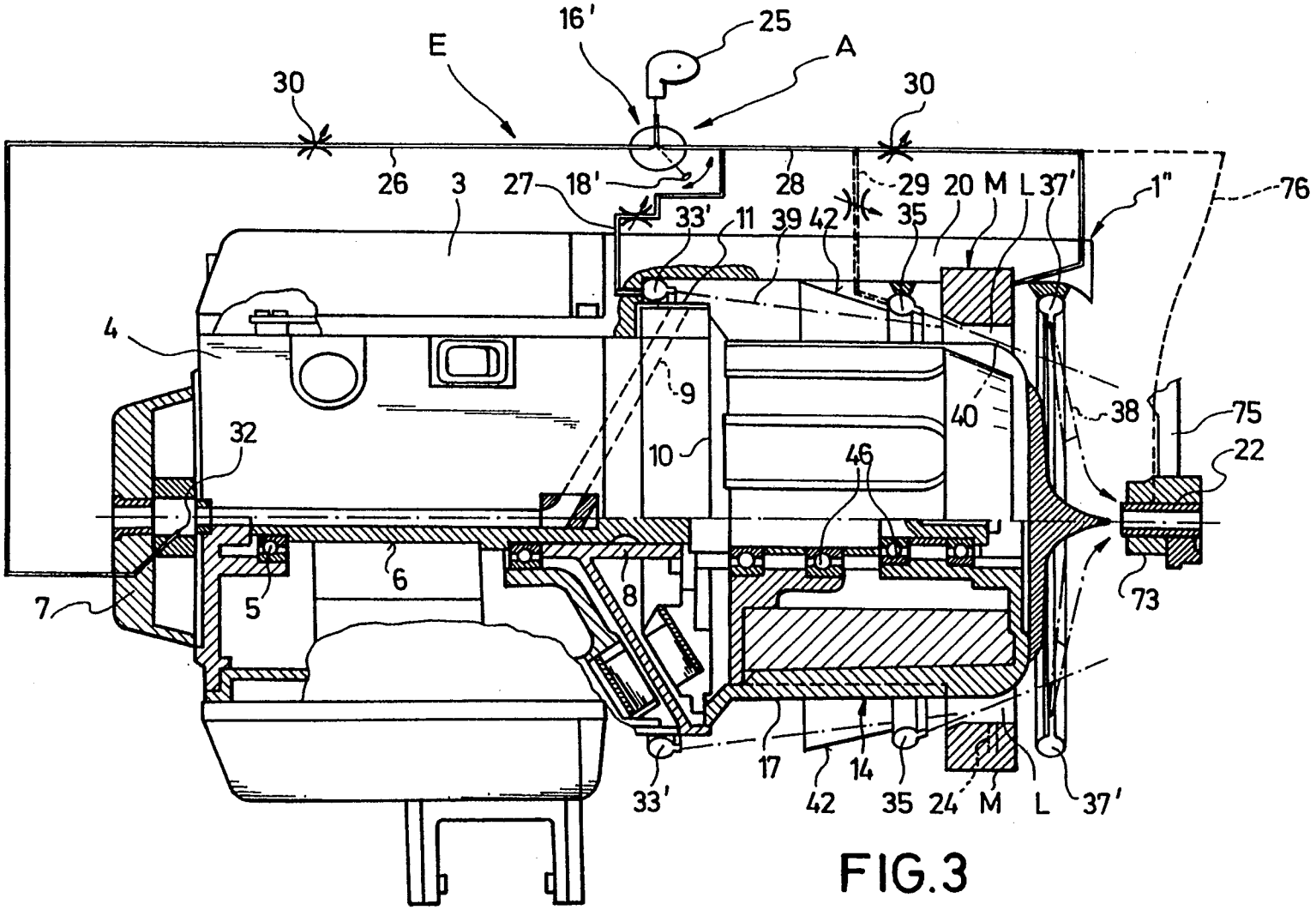
FIG. 3 is a longitudinal section through a modified embodiment.

The yarn storage and feed device 1'' according to FIG. 3 differs from the two preceding embodiments by a measuring device M for determining the length of the yarn removed, e.g., for the weft yarn supply to a jet-weaving machine (not shown). Instead of the direction-jet nozzles, stationary ring nozzles 33', 35 and 37' are provided for making the yarn end, which exits from outlet 11, independent of the rotary position in which the winding element 9 has been stopped, namely by means of air curtains 39, 40, 38 relative to guide opening 22. The measuring device M is ring-shaped and supported in arm 20. The guide opening 22 is arranged on a separate holding device 75. Stop elements 24 are circumferentially distributed and movably supported in the measuring device M. Each of stop elements 24 is movable by an actuating magnet (not shown) from a retracted position leaving a passage gap L radially through the passage gap L up to storage body 14 to block the withdrawal of the yarn in the known manner as soon as the desired withdrawal length has been reached. The detailed construction of the measuring device M and its function are disclosed in EP-A 2-101 110, which is herewith referred to. A funnel-shaped guide surface 42 arranged upstream of the ring nozzle 35 serves to guide air curtain 39.

The activating device A for the threading device E comprises a rotary slide valve 16' which can be operated manually by means of a lever 18' and which has three switching positions. In the first switching position the pressure source 25 is separated from all supply lines 26, 27, 28 and the additional supply line 29 to ring nozzle 35. In the second switching position, only supply line 26 is connected to pressure source 25. In the third switching position, all supply lines are connected to pressure source 25.

In case of failure the rotary slide valve 16' is adjusted by an operator in response to the presence of total failure or partial failure for eliminating said failure. Instead of the manually operable activating device, the activating devices according to FIGS. 1 and 2 could be provided for permitting semi-automatic or fully automatic operation.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A yarn storage and feed device for a textile machine, comprising:

(a) a main body;

(b) a yarn winding element supported on said main body and drivingly supported for rotation;

(c) a storage drum provided with a storage surface thereon for a yarn supply consisting of tangential windings of yarn wound upon said storage surface, the yarn being withdrawn endwise of said storage drum and through a guide opening;

(d) a threading device which comprises a compressed-air conveying system that includes direction-jet nozzles provided between a point of inlet into said yarn storage and feed device and said guide opening, at least one first said direction-jet nozzle being arranged between said point of inlet and an outlet of said winding element, and at least a second said direction-jet nozzle being arranged downstream of said outlet; and (e) an activating device for activating said direction-jet nozzles, said activating device including means for defining two operating modes including (1) a partial-failure mode which represents a condition wherein yarn is still stored on said storage drum after a yarn breakage has occurred between said inlet and said storage drum and (2) a total-failure mode which represents a condition wherein a yarn breakage has occurred and said yarn supply has been totally consumed from said storage surface, said activating device having means for activating only said first direction-jet nozzle when said activating device is in said partial-failure mode, said activating device having means for activating said first and second direction-jet nozzles when said activating device is in said total-failure mode, whereby in the event of a partial failure the yarn is blown downstream of said outlet and in the event of a total failure the yarn is blown from the point of inlet to the guide opening.

2. A yarn storage and feed device according to claim 1, wherein said activating device includes first and second activating parts, said first activating part being connected to said first direction-jet nozzle and said second activating part being connected to all of said direction-jet nozzles between said outlet and said guide opening, wherein said first and second activating parts activate, respectively, the direction-jet nozzles to which they are connected.

3. A yarn storage and feed device according to claim 2, wherein said means for defining the operating modes of said first and second activating parts of said activating device is dependent upon a rotary position of said winding element.

4. A yarn storage and feed device according to claim 3, wherein said activating device includes means for operating said first and second activating parts in said total-failure mode when said rotary position of said winding element corresponds to a predetermined threading position, and said activating device includes means for operating said first and second activating parts in said partial-failure mode when said rotary position of said winding element corresponds to a non-threading position.

5. A yarn storage and feed device according to claim 2, wherein a manually operable change-over switch is provided for said first and second activating parts.

6. A yarn storage and feed device according to claim 2, further including an operation control device that controls said first and second activating parts.

7. A yarn storage and feed device according to claim 9, wherein said activating device includes means for operating said activating device in said total-failure mode when said rotary position of said winding element corresponds to a predetermined threading position, and said activating device includes means for operating said activating device in said partial-failure mode when said rotary position of said winding element corresponds to a non-threading position.

8. A yarn storage and feed device according to claim 2, wherein said second directional-jet nozzle includes a said directional-jet nozzle disposed adjacent the outlet and a further said directional-jet nozzle disposed downstream thereof for directing the yarn toward the guide opening.

9. A yarn storage and feed device according to claim 1, wherein said means for defining the operating modes of said activating device is dependent upon a rotary position of said winding element.

10. A yarn storage and feed device according to claim 1, wherein a manually operable change-over switch is provided for switching said activating device between said modes.

11. A yarn storage and feed device according to claim 1, further including an operation control device that controls said activating device.

12. A yarn storage and feed device according to claim 11, further including at least one yarn sensor and a failure classifying device which is in communication with said activation device, wherein said failure classifying device processes signals from said at least one yarn sensor, said signals being indicative of a partial failure or total failure condition in said yarn storage and feed device, whereby said activating device includes means for automatically placing said activating device into one of said partial-failure and said total-failure modes.

13. A yarn storage and feed device according to claim 12, wherein said at least one yarn sensor is a yarn supply size sensor, and said signals processed by said failure classifying device represent either a partial failure condition where stored yarn (V) remains on said storage surface or a total failure condition where no yarn remains on said storage surface.

14. A yarn storage and feed device according to claim 12, wherein said winding element possesses a predetermined threading position, and said failure classifying device includes means for determining said partial-failure condition and total-failure condition of said yarn storage and feed device by the displacement of said winding element into one of a total-failure threading position and a partial-failure threading position.

15. The yarn storage and feed device according to claim 12, wherein said failure classifying device is incorporated into said operation control device.

16. A yarn storage and feed device according to claim 1, wherein said second directional-jet nozzle includes a said directional-jet nozzle disposed downstream of the outlet and at the guide opening.

17. A yarn storage and feed device according to claim 1, wherein the activating device includes a flow control valve shiftable between first and second flow-controlling positions which respectively correspond to said partial-failure and total-failure modes, said flow control valve including means for supplying air solely to said first directional-jet nozzle when said flow control valve is in said first position, said flow control valve including means for supplying air to both said first and second directional-jet nozzles when said flow control valve is in said second position, said flow control valve being movable into a third position and including means for isolating all of said directional-jet nozzles from the supply of air when said flow control valve is in said third position.

18. A yarn storage and feed device according to claim 17, wherein an operating device is coupled to and effects switching of said flow control valve between said positions.

* * * * *